US007185977B2

(12) United States Patent
Kyogoku et al.

(10) Patent No.: US 7,185,977 B2
(45) Date of Patent: Mar. 6, 2007

(54) INK TANK AND INK SUPPLYING APPARATUS

(75) Inventors: Hiroshi Kyogoku, Tokyo (JP); Shumpei Takenaka, Tokyo (JP); Keiji Nagira, Tokyo (JP); Noboru Nabeta, Tokyo (JP); Hiroshi Matsuoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 245 days.

(21) Appl. No.: 10/997,176

(22) Filed: Nov. 24, 2004

(65) Prior Publication Data

US 2005/0117003 A1 Jun. 2, 2005

(30) Foreign Application Priority Data

Dec. 2, 2003 (JP) ..... 2003-402374

(51) Int. Cl.
*B41J 2/175* (2006.01)

(52) U.S. Cl. ..... 347/86

(58) Field of Classification Search ..... 347/85–87
See application file for complete search history.

(56) References Cited

U.S. PATENT DOCUMENTS 6,022,102 A * 2/2000 Ikkatai et al. ..... 347/85
6,402,306 B1 6/2002 Childers
6,460,985 B1 10/2002 Olsen
6,464,346 B2 10/2002 Otis, Jr.
6,520,630 B1 2/2003 Oda et al.
2001/0009432 A1 7/2001 Olsen
2003/0043240 A1* 3/2003 Dowell ..... 347/85

FOREIGN PATENT DOCUMENTS

JP 08-112913 A1 5/1996
JP 2001-246761 A1 9/2001

* cited by examiner

*Primary Examiner*—An H. Do
(74) *Attorney, Agent, or Firm*—Canon U.S.A. Inc I.P. Div

(57) ABSTRACT

A liquid accommodating container having a configuration that allows ink to be substantially used up, does not require an increase in size or a complicated construction, and can be fabricated at lower costs. The container includes an ink chamber for holding ink and having an upper air layer. A second chamber is provided in the upper air layer. A partition divides the second chamber into an ink absorber chamber that accommodates an ink absorber and a sub ink chamber for storing a small amount of ink. A third chamber defines a space between the atmosphere and the ink absorber. An upper portion of the sub ink chamber adjacent to the ink chamber is open so as to provide communication between the upper air layer and the atmosphere through the intermediary of the sub ink chamber and the ink absorber chamber in this order. An atmosphere communicating hole is defined. A print head that discharges ink of the ink chamber is provided at the bottom of the container.

10 Claims, 6 Drawing Sheets

INK TANK AND INK SUPPLYING APPARATUS

BACKGROUND OF THE INVENTION

1. Field of the Invention

The present invention relates to an ink tank that holds ink to be supplied to a recording head mounted on an ink-jet recording apparatus adapted to discharge the ink from the recording head to perform recording. The present invention further relates to an ink supplying apparatus for supplying ink to a recording head.

2. Description of the Related Art

An ink-jet recording apparatus has an ink-jet type liquid discharge head (hereinafter referred to as "the print head") mounted on a carriage. When the carriage moves in a scanning manner from one end to the other end across a print medium, such as paper, film or fabric, a control system controls the print head to inject ink droplets onto the print medium so as to form a desired image and characters.

The ink is supplied to the print head from an ink supply source that moves together with the carriage or an ink supply source (liquid accommodating container, such as an ink tank) provided on a main body of a printing system that does not move together with the carriage.

If the ink supply source does not move together with the carriage, then the ink supply source connects an ink supply tube, which is used for continuously replenishing ink to the print head, to the print head thereby to replenish the ink.

The ink can be replenished also by positioning the print head at an ink replenishing station that permits easy connection between the print head and the ink supply source so as to intermittently connect the print head with the ink supply source, as necessary.

The ink supply source adapted to move together with the carriage is mounted on the carriage such that the ink supply source and the print head can be separated, and the ink supply source is replaced when it runs out of ink.

The print head is replaced when its service life expires. The ink supply source may be made integral with the print head. In this case, the whole assembly of the print head and the ink supply source is replaced when the ink runs out.

It is important for the ink supply source to reliably supply ink to the print head regardless of the position of the ink supply source in the printing system.

For the print head to properly function, it is essential to supply ink without interruption and to generate and maintain a negative pressure in the ink supply source and/or the print head.

The aforementioned negative pressure is a pressure in the print head that is negative relative to atmospheric pressure. If the negative pressure is excessively high, the concave surface of an ink meniscus in an orifice of a nozzle assembly through which ink is discharged becomes excessively large. This causes air bubbles to be easily captured after the ink is discharged, leading to discharge failure.

If the negative pressure is excessively low, the interfacial force by the surface tension of the ink at the orifice is exceeded, causing leakage of the ink. For this reason, the negative pressure is required to maintain the head pressure involved in the supply of the ink at a lower level than the atmospheric pressure so as to prevent the ink from leaking from the ink supply source or the print head.

It is required to apply a certain negative pressure to the ink supply source and/or the print head over a wide range of temperatures to which the printing system is subjected during its storage or operation and also over a wide range of atmospheric pressures. As an ink supply apparatus to meet the requirement, there is an ink-jet recording apparatus disclosed in Japanese Patent Laid-Open No. 2001-187459 (corresponding U.S. Pat. No. 6,520,630).

Similar configurations have been disclosed in Japanese Patent Laid-Open No. 2001-246761 and Japanese Patent Laid-Open No. 2001-130024 (corresponding U.S. Reference Nos. 6402306, 6460985, 6464346 and 2001009432) and their advantages have been described. Another conventional ink tank is shown in FIG. 6.

FIG. 6 is a sectional view showing a first conventional example of an ink supply apparatus.

The interior of an ink tank 12 is separated by a wall into an ink chamber 13 for holding an ink 14 in a free state and an ink absorber chamber 15 for accommodating an ink absorber 16 for absorbing the ink.

The ink tank bottom side of the wall is in communication with the ink chamber 13 and the ink absorber chamber 15 through the intermediary of a communicating portion. A plurality of grooves 24 extending to the communicating portion is formed in the wall in the vertical direction.

The ink absorber 16 is constructed of a member, such as a porous member or a fiber member, that generates a capillary force.

An optical reflective member 20 for detecting the residual quantity of the ink is disposed on the inner surface of the bottom portion of the ink chamber 13.

The ceiling portion of the ink chamber 13 has an ink inlet 17 through which the ink 14 is poured in. The ink inlet 17 is connected to an ink supply tube (not shown) and shut off from the atmosphere.

The ceiling portion of the ink absorber chamber 15 has an atmosphere communicating hole 18 for communication between the ink absorber chamber 15 and the atmosphere.

A print head 11 is provided on the bottom portion of the ink absorber chamber 15.

A filter 19 is provided in an ink passage 22 connecting the ink absorber chamber 15 and a head liquid chamber 21 of the print head 11.

The ink absorber 16 in the ink absorber chamber 15 functions as a buffering means against changes in ambient environments. For instance, if an ambient air pressure drops or an ambient temperature rises, the air in the ink chamber 13 expands. In this case, the ink in the ink chamber 13 equivalent to the air expansion moves through the intermediary of the communicating portion, and the ink absorber 16 in the ink absorber chamber 15 absorbs the ink, thus making it possible to apply a proper negative pressure to the print head even when environmental changes take place.

The grooves 24 provided in the partition between the ink chamber 13 and the ink absorber chamber 15 permit easy movement of the ink and the air between the ink chamber 13 and the ink absorber chamber 15 so as to allow stable ink supply to be accomplished and also allow air bubbles to be easily separated when the air bubbles move into the ink chamber 13 when supplying the ink.

FIG. 7 is a sectional view showing a second conventional example of the ink supply apparatus.

The description of the second conventional example will be mainly focused on aspects that are different from the first conventional example.

The ink supply apparatus shown in FIG. 7 is different from the apparatus shown in FIG. 6 in that an ink absorber in an ink absorber chamber 15 is composed of two ink absorbers 16*b* and 16*c* having different densities. The bottom of an ink tank 12 is provided with a joint 30 to be connected with a print head 11. The interior of the joint 30 provides an ink lead-out passage for leading out the ink from the ink absorber chamber 15, an ink absorber 16*a* being disposed in the ink lead-out passage.

The ink absorber 16*a* restrains ink leakage and makes the print head 11 and the ink tank 12 detachable. The print head 11 has an ink passage 22 to be connected to a head liquid chamber 21, the ink passage 22 being connected to an ink lead-out passage of the joint 30 through the intermediary of the filter 19. A gasket member 25 disposed between the joint 30 and the print head 11 prevents ink leakage from between the joint 30 and the print head 11.

The ink absorber 16*c* in the ink absorber chamber 15 functions as a negative pressure control means when ambient environments change. For example, if air pressure drops or the temperature in the ink tank 12 rises, the pressure of the air in an upper layer portion of the ink chamber 13 that stores ink in a free state becomes relatively higher. As a result, the amount of ink equivalent to the volume of the expanded air is pushed out of the ink chamber 13 into the ink absorber chamber 15 and absorbed by the ink absorber 16*c* through the intermediary of grooves 24. This makes it possible to maintain a negative pressure within a proper range without applying an excessive positive pressure to the print head 11 when an internal pressure changes.

The density of the ink absorber 16*a* is higher than that of the ink absorber 16*b*, and its strong capillary force draws the ink into the print head 11 and also restrains ink leakage. The capillary force of the ink absorber 16*b* is stronger than that of the ink absorber 16*c* to make it difficult for ink to remain in the ink absorber 16*c* toward the end of use of the ink tank 12. The ink tank 12 is led by a guide or the like (not shown) to the print head 11 and detachably and hermetically connected thereto by the gasket member 25.

FIG. 8 is a sectional view showing a third conventional example of the ink supply apparatus. The description of the third conventional example will be focused primarily on aspects different from that of the first conventional example.

The ink supply apparatus shown in FIG. 8 differs from the apparatus shown in FIG. 7 in that the wall constituting an ink chamber 13 is provided with an air suction port 27 and an ink inlet 26. The air suction port 27 that draws in air from the ink chamber 13 is maintained in a hermetically sealed state with a valve. Connected to the ink inlet 26 is a flexible ink supply tube (not shown) for supplying ink 14 from a main tank fixed in a recording apparatus main body.

Japanese Patent Laid-Open No. 8-112913 has disclosed an example configuration for replenishing ink from a main tank to a sub tank. In the example, a suction pump performs an operation for restoring an ink discharge function of a print head and the same suction pump replenishes ink.

In the conventional ink supply apparatuses described above, ink is held by the capillary forces of the ink absorbers, so that the ink can be held or discharged only within the range of about 20% to about 70% of the volume of the ink absorbers, posing a problem of poor efficiency of use of the ink tank. If the ink tank is made larger to increase the amount of ink to be held in the ink tank in order to prolong the service life of the ink tank, then the amount of air that increases as the ink is consumed will increase accordingly. This would require the volume of an ink absorber functioning as a buffer, inevitably leading to a larger size of the ink tank.

Furthermore, a larger-capacity ink absorber would be required, so that more wastes would result when the ink tank is disposed of, or a dye, which is a dissolved component in a liquid, may coagulate in an extended storage of the ink tank. Moreover, requiring an ink absorber having a larger capacity would lead to increased manufacturing cost of a replacement ink tank. In addition, to supply ink from a main tank into an ink chamber of an empty ink tank, a separate air suction means would be necessary to draw out the air in the ink chamber 13 through the air suction port 27, as illustrated in FIG. 8.

If the ink is drawn in from a nozzle assembly to replenish ink into the ink chamber, as another means, then a large amount of redundant ink would be drawn in and consumed. Even if the excess ink that has been drawn in is recycled, measures against dust and an additional ink passage would be required. Hence, this means is not a good solution.

SUMMARY OF THE INVENTION

The present invention is directed to a liquid accommodating container having an improved configuration that allows substantially all ink contained therein to be consumed and that can be manufactured at a relatively low cost, while avoiding an increase in size or a complicated structure.

The liquid accommodating container also uses no or a minimum of ink absorbing members that may produce wastes when an ink tank is disposed of.

The present invention is also directed to a liquid supply apparatus that continues to supply ink to a recording head under a negative pressure within a predetermined range while the recording head is operating, over a predetermined wide range of temperature and until ink runs out from a full level.

According to one aspect of the present invention, there is provided a container for holding a liquid to be supplied to a liquid discharge head that discharges the liquid, including a housing; a first chamber adapted to store the liquid in a free state; a second chamber provided on the housing and defining a first space that facilitates communication between the first chamber and an atmosphere, wherein the first chamber has a portion in communication with the atmosphere; a liquid absorbing member disposed in the second chamber; and a third chamber defining a second space between the atmoshpere and the liquid absorbing member.

According to the aforesaid construction, the liquid absorbing member disposed in the second chamber, which forms the space that provides communication between the first chamber and the atmosphere, is impregnated with the liquid from the first chamber to shut off the first chamber from the atmosphere. When the liquid in the first chamber is being consumed, a negative pressure is generated in the first chamber by a capillary force of the liquid absorbing member. The negative pressure increases as more liquid is consumed. When the negative pressure exceeds a certain pressure level, air gradually enters, in the form of minute air bubbles, into the liquid absorbing member from the atmosphere. The air also enters the first chamber little by little, so that the negative pressure is prevented from rising above a predetermined level, thereby maintaining a stable negative pressure in the first chamber. This arrangement stabilizes a discharging operation of the liquid discharge head in communication with the first chamber in the liquid accommodating container, permitting good recording performance to be maintained. If an atmospheric pressure drops or an ambient temperature or the temperature of equipment rises, then expanded air in the first chamber is gradually released to the atmospheric side. Liquid is supplied to the second chamber located in the upper portion of the container when the liquid in the first chamber vibrates when the container is mounted on a carriage and moved during a recording operation.

In one embodiment, the second chamber includes a liquid absorbing member accommodating chamber for holding the liquid absorbing member and a fourth chamber for storing liquid in the free state, such that they are separated by a wall. The liquid absorbing member accommodating chamber is in direct communication with the atmosphere, the liquid absorbing member accommodating chamber and the fourth chamber are in communication at an opening located at a lower portion of the wall therebetween, and the fourth chamber and the first chamber are in communication. This arrangement maintains a stable negative pressure in the first chamber when the liquid is consumed.

In another embodiment, a third space is provided in the upper portion. A replacement container may further replenish liquid to the first chamber.

The liquid accommodating container is provided with a liquid inlet through which liquid is injected into the first chamber. A liquid lead-out portion of the aforesaid replacement container communicates with the liquid inlet.

According to another aspect of the present invention, there is provided a liquid accommodating container for accommodating a liquid to be supplied to a liquid discharge head that discharges the liquid, including a housing; a first chamber provided within the housing and adapted to store the liquid in a free state, the first chamber having an upper space above the liquid stored therein; a second chamber provided within the housing and a second chamber separated from the first chamber and in the upper space; an atmosphere communicating hole defined in the housing and allowing communication between the first chamber and an atmosphere via the second chamber; a hydrophobic porous member which is disposed between the atmosphere communicating hole and the second chamber; and a liquid absorbing member disposed adjacent to the porous member and in second chamber; and an empty chamber 28 provided within the housing; and an empty chamber communicated between the second chamber and the atmosphere communicating hole.

In the construction described above, the fourth chamber that forms the liquid storing space independent from the first chamber is provided in the upper layer portion of the first chamber that stores the liquid in a free state, and the porous member and the liquid absorber are impregnated with the liquid from the fourth chamber at an end portion and the empty chamber communicated between the second chamber and the atmosphere communicating hole and the atmosphere communicating hole to keep the interior of the first chamber shut off from the atmosphere by the interfacial force of the surface tension of the liquid. When the consumption of the liquid of the first chamber is begun, a negative pressure is generated in the first chamber by a capillary force of the liquid absorbing member, and the negative pressure increases as the consumption of the liquid proceeds.

When the negative pressure exceeds a certain pressure level, air gradually enters in the form of minute air bubbles into the liquid absorbing member from outside the container, and also enters the first chamber by a small amount at a time. This prevents the negative pressure from increasing to exceed a predetermined level, thus maintaining the balance between the negative pressure in the first chamber and the interfacial force of the liquid in the liquid absorber. Hence, it is possible to stabilize a discharge operation of the liquid discharge head in communication with the first chamber, thus maintaining good recording performance in the liquid accommodating container. If the air in the first chamber expands or contracts due to a change in air pressure or temperature, then air is released to or taken in from the atmosphere side by a small amount at a time through the intermediary of the liquid absorbing member impregnated with the liquid. This arrangement makes it possible to prevent the internal pressure in the first chamber from increasing above or decreasing below a predetermined level. The porous member in contact with the atmosphere communicating hole uses a material permeable to a gas but impermeable to a liquid, so that the liquid does not leak out through the atmosphere communicating hole even if the air in the first chamber expands. The liquid accommodating container is further provided with a joint to be connected with the liquid discharge head, and the joint has a liquid lead-out passage for leading out the liquid of the first chamber to the liquid discharge head.

In one embodiment, the liquid absorbing member is disposed in a compressed state in the second chamber. The housing has an air lead-in passage provided between the atmosphere communicating hole and the liquid absorbing member. In another embodiment, a liquid discharge nozzle assembly is provided at the liquid discharge head. Also, an atmosphere communicating hole allows communication between the air in the second chamber and atmospheric air at the vicinity of the liquid discharge nozzle assembly.

In yet another aspect, a liquid supply apparatus includes the liquid accommodating container described above and a suction unit configured to simultaneously drawing in the air from the second chamber and the liquid from the liquid discharge nozzle assembly through the atmosphere communicating hole.

As explained above, the present invention makes it possible to minimize the volume of the liquid absorbing member that used to take up a large volume in the liquid chamber in the conventional examples, so that the liquid absorbing member uses only a part of an upper portion of the liquid chamber. With this arrangement, all liquid can be accommodated in the liquid accommodating container in a free state. This means that more liquid can be accommodated in the same size, or the same amount of a liquid can be held in a smaller liquid chamber. Moreover, it is possible to provide an efficient liquid accommodating container that exhibits high reliability against environmental changes and allows all liquid therein to be used up by a simple method in which expansion and contraction of air in and out of the liquid chamber caused by environmental changes are directly accommodated using a small liquid absorbing member, thus obviating the need of moving the liquid.

Furthermore, a large-capacity liquid absorbing member can be eliminated from a liquid accommodating container, which is a consumable, permitting reduced cost to be achieved.

Further features and advantages of the present invention will become apparent from the following description of the embodiments with reference to the attached drawings.

DESCRIPTION OF THE EMBODIMENTS

The following will explain embodiments in accordance with the present invention with reference to the accompanying drawings.

First Embodiment

Figure 1:
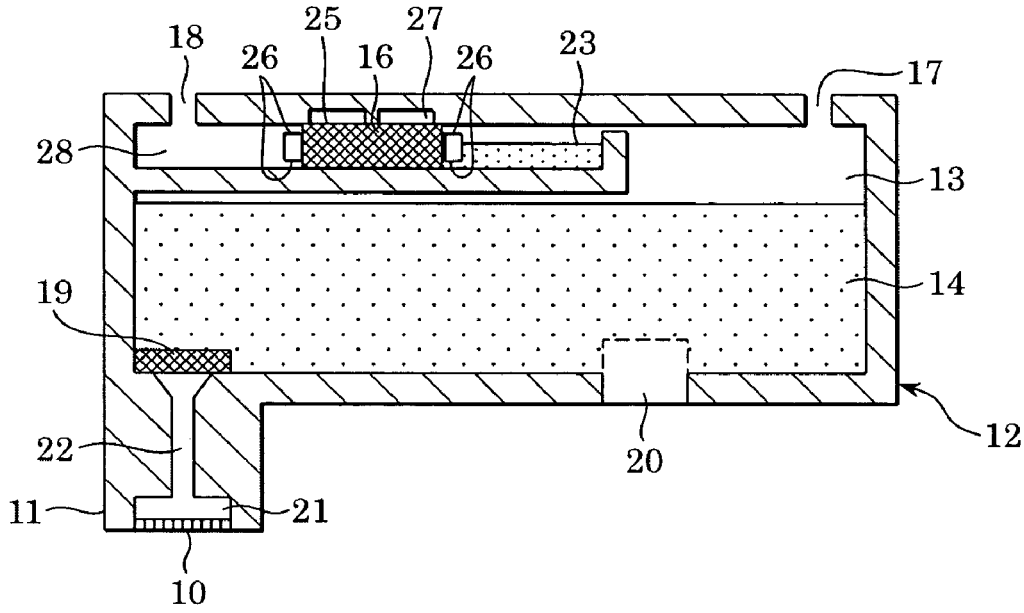
FIG. 1 is a sectional view of a liquid accommodating container according to a first embodiment of the present invention.

FIG. 1 is a sectional view showing a liquid accommodating container according to a first embodiment of the present invention.

Referring to FIG. 1, an interior of an ink tank 12 provides an ink chamber 13 holding an ink 14, and an air layer fills an upper portion of the ink chamber 13. A print head 11, which is an ink-jet recording head that discharges ink droplets to perform recording, is provided at a bottom of the ink tank 12.

A ceiling of the ink tank 12 has an atmosphere communicating hole 18 and an ink inlet 17. If an ink supply source that supplies ink to the ink tank 12 is fixed to the main body of a recording apparatus rather than being mounted on a carriage that moves the ink tank 12 provided with the print head 11, then the ink inlet 17 is connected to an ink supply tube (not shown) so as to be shut off from the atmosphere. If the ink supply source is mounted on a carriage together with the ink tank 12, then the ink inlet 17 is connected with the ink supply source, thus being shut off from the atmosphere.

An ink remaining amount detecting member 20 is disposed at the bottom of the ink tank 12. The member 20 is formed of a transparent plastic optical reflecting member that has been molded such that emitted light (not shown) returns when the ink chamber 13 becomes empty and a liquid therein is replaced by air, which results in a change in a refractive index ratio. The print head 11 is made integral with the ink tank 12 and connected with the ink tank 12 by an ink passage 22. A filter 19 is provided at a connection between the ink chamber 13 and the ink passage 22, and the ink 14 in the ink chamber 13 is guided to the ink passage 22 of the print head 11 through the intermediary of the filter 19.

The filter 19 is provided to prevent wastes, foreign matters, coagulated components of ink, air bubbles, or the like from entering the print head 11. The filter 19 uses a filter that has filtering accuracy of about 20 μm in order to block foreign matters that may clog the nozzles of the print head 11. A nozzle assembly 10 of the print head 11 is formed of numerous nozzles arranged at a high density. For example, 128 nozzles may be formed a density of 300 dpi (about 300 dots per 25.4 mm). Each nozzle is provided with a heating element for generating air bubbles by energization to discharge ink in the form of droplets. In FIG. 1, ink droplets are discharged downward. The discharging direction crosses a surface of a recording medium.

The principle of discharging droplets of the ink-jet recording head used in the present invention is not limited thereto. As an alternative, a piezoelectric element, such as a piezo element, may be disposed in each nozzle to replace the heating element, so as to discharge droplets by vibrational energy of the piezoelectric element.

Although not shown, a printed wiring board or the like for supplying electrical signals to the print head 11 is provided. A housing of the ink tank 12 is rigid, and a material exhibiting high resistance to ink is selected for the housing.

Construction of the ink chamber 13 will be further explained.

The ink chamber 13 is initially filled up to about 80% with the ink 14.

The air layer in the upper portion of the ink chamber 13 is provided with a single room by a partition. The room is divided into an ink absorber chamber 25 for accommodating an ink absorber 16 for holding ink, a sub ink chamber 23 for storing a small amount of ink, and an empty chamber 28. A portion above the wall of the sub ink chamber 23 that is adjacent to the ink chamber 13 is opened to provide communication between the air layer in the upper portion of the ink chamber 13 and the atmosphere in the order of the sub ink chamber 23, the ink absorber chamber 25, and the empty chamber 28. In addition, the atmosphere communicating hole 18 is formed in the ceiling of the empty chamber 28. The empty chamber 28 functions as a space for receiving ink coming out of the ink absorber 16 when ink is drawn out of the nozzle assembly 10 at the beginning of suction or after the completion of filling the ink chamber 13 with ink.

Although the atmosphere communicating hole 18 is illustrated simply in a large, short hole in FIG. 1, it is actually formed to be a very small, long hole to prevent ink from flowing out. When a carriage on which the ink tank 12 with the print head 11 is mounted is scanned in front/back directions of a paper surface in FIG. 1 to perform a recording operation, the ink in the ink chamber 13 is oscillated and easily supplied to the sub ink chamber 23 above the ink chamber 13, because the dimension of the ink chamber 13 in the scanning direction is small, namely, slightly smaller than about 10 mm, as compared with the section shown in FIG. 1. Thus, a small amount of ink is always stored in the sub ink chamber 23. Needless to say, a blocking wall for restraining the small amount of stored ink from moving back into the ink chamber 13 may be installed on the wall of the sub ink chamber 23 adjacent to the ink chamber 13.

A plurality of communicating holes 26 is formed in upper and lower portions of a side wall of the ink absorber chamber 25 that is adjacent to the sub ink chamber 23, and in upper and lower portions of a side wall thereof adjacent to the empty chamber 28. The holes in the upper portions of the side walls of the ink absorber chamber 25 are used for atmosphere, while the holes in the lower portions of the side walls thereof are used for replenishing ink.

At least one extremely small space 27 is provided on the ceiling surface of the ink absorber chamber 25. The space 27 may take a slit-like configuration. The space 27 serves as an extremely small air reservoir through which the air in the upper portion of the ink chamber 13 and the air (atmospheric air) outside the ink tank can be gradually moved in/out in the form of minute air bubbles through the intermediary of the atmosphere communicating hole 18.

For the ink absorber 16, a polyester felt, for example, may be used; however, the material for the ink absorber 16 is not limited thereto. Any material may be used as long as it produces an appropriate capillary force at the interface with the ink. For instance, a porous material, such as a polyurethane material, or a fibrous structure or the like may be used. Furthermore, a mesh type material, such as a wire mesh or a resinous mesh, a porous member or the like may be used. The filter may use, in particular, a knitting component made of a metal fiber or a resinous fiber. The filter may have filtering accuracy that is coarser than that of the filter 19 disposed between the ink chamber 13 of the ink tank 12 and the ink passage 22 in the print head 11 connected to the ink chamber 13; it may have a filtering accuracy of, for example, about 70 μm. The filter, however, can be formed of multiple layers of metal laminates with ink held among the gaps thereof or a mesh type metal fiber member rather than a chemical member that may cause ink to deteriorate in prolonged use.

A capillary member constituting the ink absorber 16 in the ink absorber chamber 25 functions as a means for controlling a negative pressure when an ambient environment changes. For instance, if an ambient air pressure drops or an ambient temperature rises, then the air in the ink chamber 13 holding ink expands. The pressure of the expanded air is gradually released outside in the form of minute air bubbles, thereby prohibiting the air pressure from increasing over a predetermined level. Conversely, if the ink in the ink chamber 13 is consumed by recording and the ink 14 decreases with a consequent drop in the internal pressure thereof, then the air adjacent to open air that has a higher pressure is gradually moved into the ink chamber 13 in the form of minute air bubbles through the intermediary of the atmosphere communicating hole 18 and the ink absorber chamber 25. This arrangement maintains the negative pressure in the ink chamber 13 substantially at a constant level. The extremely small space 27 provided in the ceiling portion of the ink absorber chamber 25 functions to temporarily trap air in the form of minute air bubbles to produce ink refilling state by a capillary member, thereby moving the air gradually rather than at once when the air inside or outside the ink tank is moved. The adjustment range of the negative pressure in the ink chamber 13 depends on the filtering accuracy. The negative pressure in the ink chamber can be maintained at an optimum level by optimizing the filtering accuracy.

Figure 2:
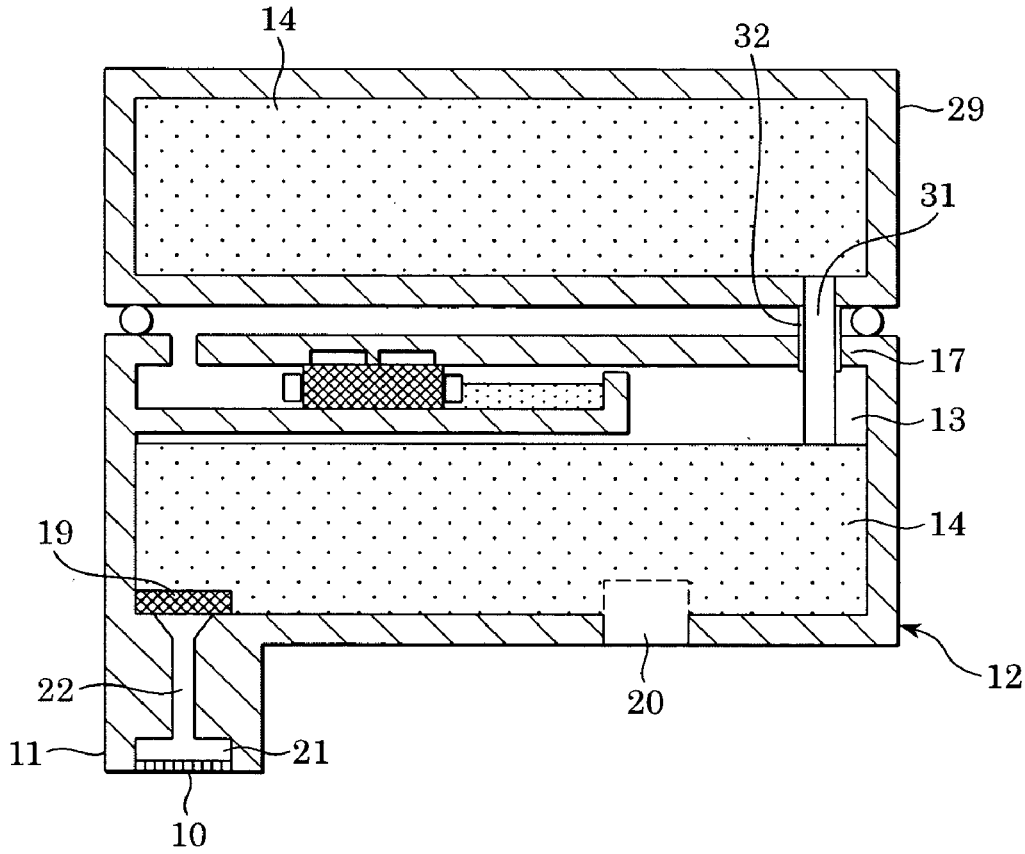
FIG. 2 is a sectional view of a replacement ink tank coupled to an ink tank shown in FIG. 1.

As shown in FIG. 2, a replacement ink tank 29 to be detachably connected to the ink inlet 17 may be mounted on the carriage together with the ink tank 12 for scanning, or a main ink tank (not shown) may be fixed to the main body of a recording apparatus rather than being mounted on the carriage and may be connected to the ink tank 12 with a flexible ink supply tube. It is needless to say that the ink inlet 17 will be sealed rather than remaining open as shown in FIG. 1. This arrangement makes it possible to hold the ink in the replacement ink tank 29 also in a free state.

Referring to FIG. 2, a connecting tube 31 extends from the replacement ink tank 29. An ink sealing means (not shown) is disengaged from the ink tank 12 through a gasket sealing member 32, and the distal end of the connecting tube 31 that has an ink inlet is inserted into the ink chamber 13 of the ink tank 12, air goes into the replacement ink tank 29 through the connecting tube 31 as the ink 14 is consumed. To replace the entered air, the ink in the replacement ink tank 29 is supplied to the bottommost end of the connecting tube 31 in the ink chamber 13. Thus, the "gas-liquid exchange" allows the ink to be supplied, as necessary, to the ink tank 12 from the replacement ink tank 29. Moreover, the ink level remains unchanged while the ink is being supplied, so that the negative pressure in the ink chamber 13 can be maintained substantially at a constant level.

Figure 6:
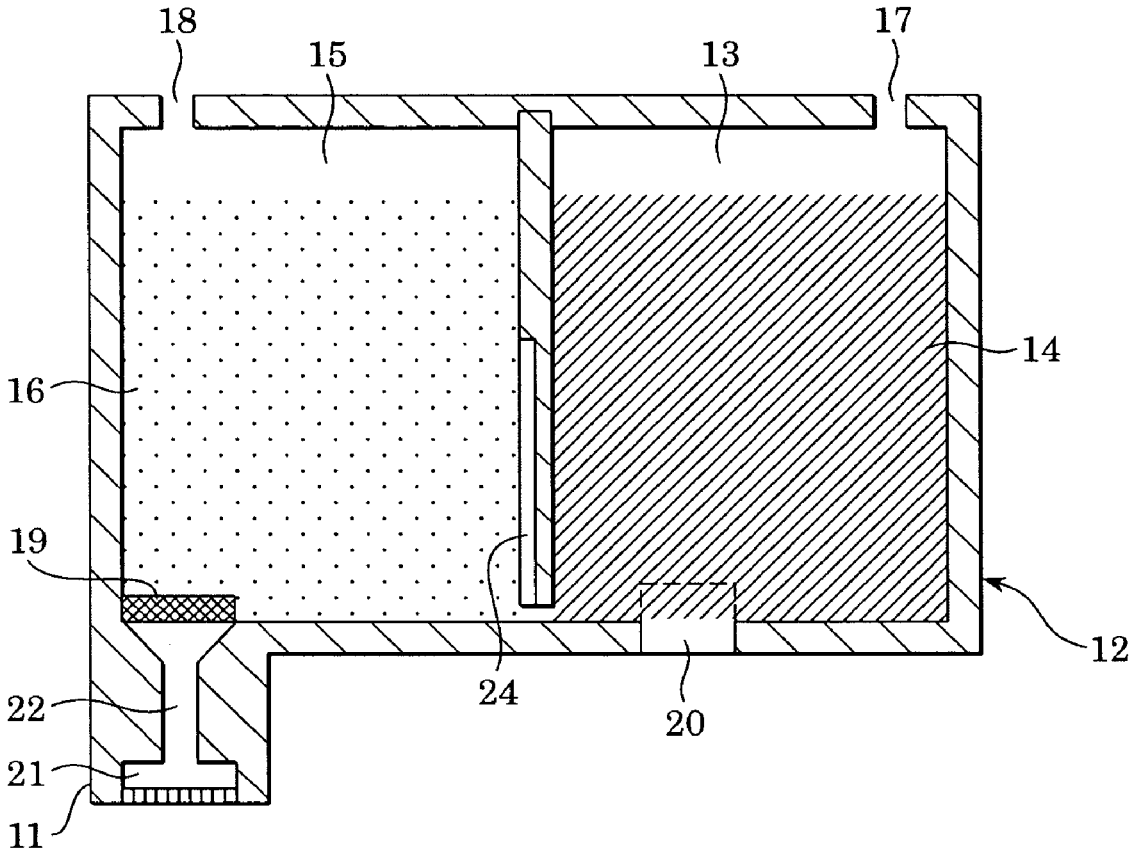
FIG. 6 PRIOR ART
FIG. 6 is a sectional view showing a first conventional example of an ink supply apparatus.
Figure 7:
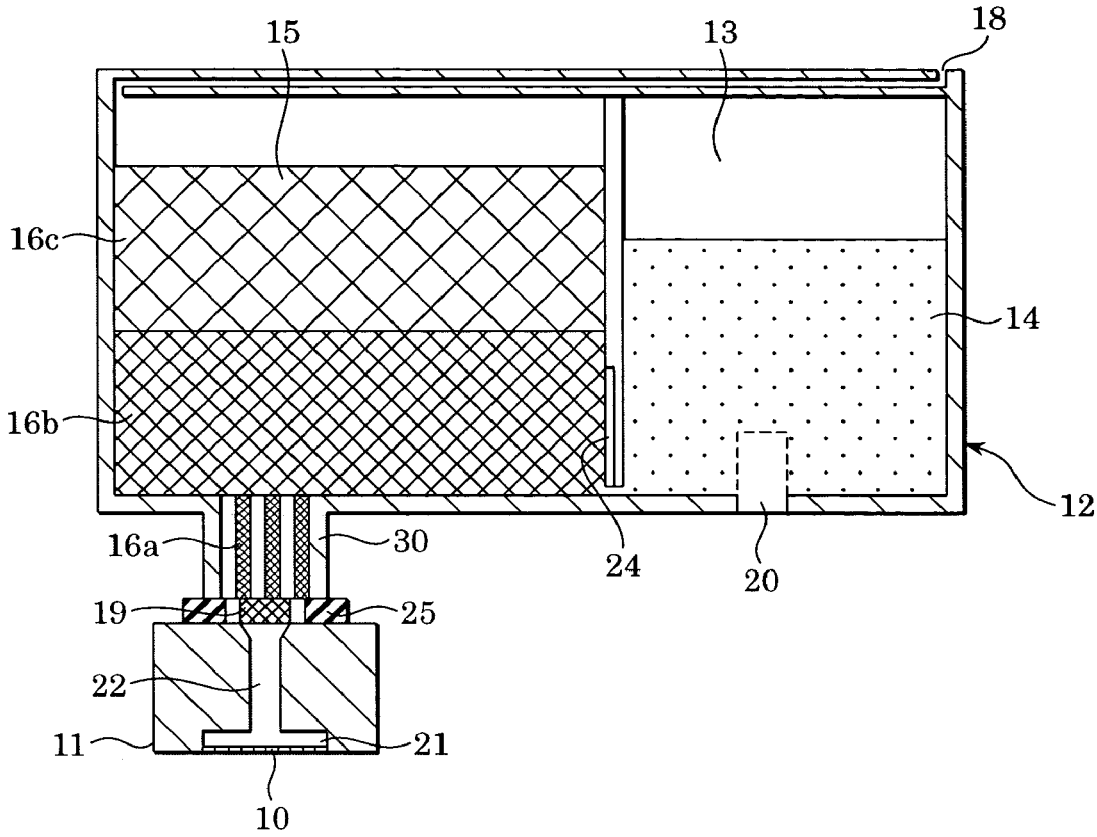
FIG. 7 PRIOR ART
FIG. 7 is a sectional view showing a second conventional example of the ink supply apparatus.
Figure 8:
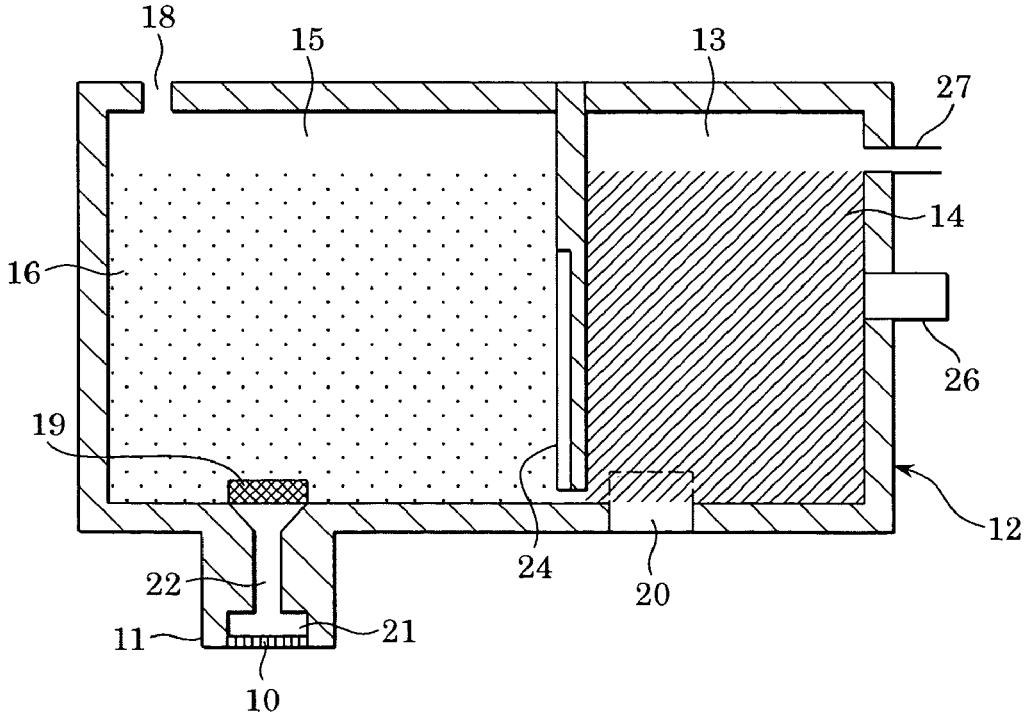
FIG. 8 PRIOR ART
FIG. 8 is a sectional view showing a third conventional example of the ink supply apparatus.

According to the embodiment described above, the ink absorber taking up a large volume in the conventional liquid accommodating containers shown in FIG. 6 through FIG. 8 occupies only a part of the upper portion of the ink chamber, making it possible to hold an ink in a free state in a major part of the ink chamber. This means that more ink can be accommodated in the same size, and the same amount of ink can be held in a smaller ink chamber. Moreover, it is possible to provide an efficient liquid accommodating container that allows all ink in the ink chamber to be used up.

Moreover, ink can be stored with high volume efficiency according to a simple method in which expansion and contraction of air inside and outside the ink chamber caused by environmental changes are directly accommodated using a small ink absorber without moving the ink. Furthermore, the large ink absorber can be eliminated from the liquid accommodating container, which is a consumable, thus permitting reduced cost to be achieved.

Second Embodiment

A second embodiment will now be explained with an emphasis on aspects that are different from the first embodiment.

Figure 3:
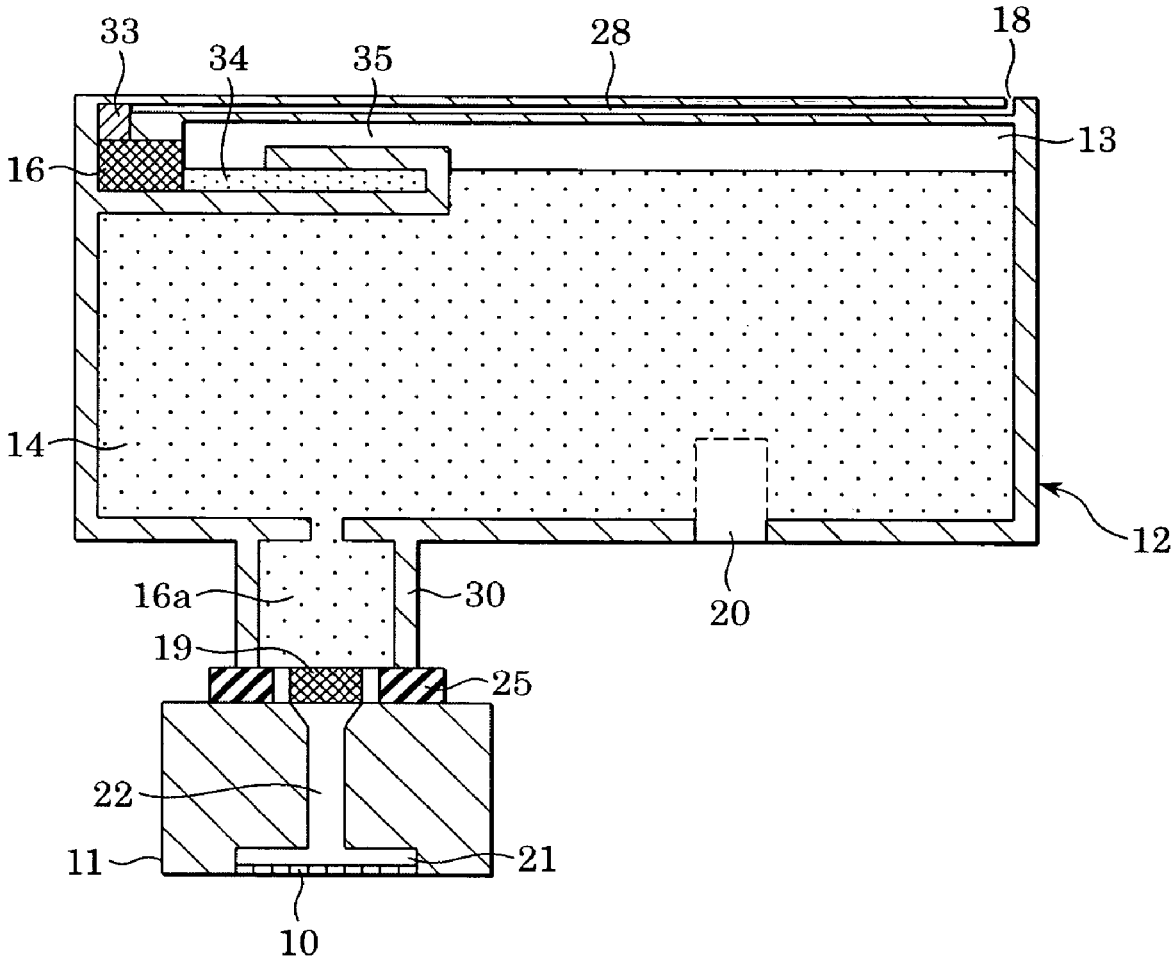
FIG. 3 is a sectional view of a liquid accommodating container according to a second embodiment of the present invention.

FIG. 3 is a sectional view showing a liquid accommodating container according to the second embodiment of the present invention.

An ink tank 12 shown in FIG. 3 has a detachable print head 11. The bottom of the ink tank 12 is provided with a joint 30 to be connected with the print head 11. The interior of the joint 30 provides an ink lead-out passage for leading out ink from an ink chamber 13, an ink absorber 16*a* being disposed in the ink lead-out passage. The ink absorber 16*a* restrains ink leakage and makes the print head 11 and the ink tank 12 detachable.

The print head 11 has an ink passage 22 to be connected to a head liquid chamber 21, the ink passage 22 being connected to an ink lead-out passage of the joint 30 through the intermediary of the filter 19. A gasket member 25 disposed between the joint 30 and the print head 11 prevents ink leakage from between the joint 30 and the print head 11.

The construction of the ink chamber 13 will now be described.

A sub ink chamber 34 for storing a small amount of ink is provided in air layer in an upper portion of the ink chamber 13 by a partition. The ceiling of the sub ink chamber 34 has an atmosphere communicating hole 18. The atmosphere communicating hole 18 has a hydrophobic porous member 33 that is permeable to gases, whereas it is impermeable to liquids. Adjacently to the hydrophobic porous member 33, an ink absorber 16 that absorbs ink is disposed in the sub ink chamber 34.

The sub ink chamber 34 is provided with an air lead-in passage 35 for leading the air in an upper layer of the ink chamber 13 into the sub ink chamber 34.

The air layer in the upper portion of the ink chamber 13 is released to the atmosphere through the air lead-in passage 35 via the ink absorber 16 in the sub ink chamber 34 and the hydrophobic porous member 33 adjacent thereto and through the atmosphere communicating hole 18.

The atmosphere communicating hole 18 is illustrated as a simple opening in the figure, whereas it is actually formed in a fine, long mazy pattern from one end to the other end in the ceiling wall of the ink tank 12 in order to prevent ink leakage or to minimize evaporation of ink. The ink chamber 13 is shut off from open air by the ink absorber 16 impregnated with the ink stored in the sub ink chamber 34. Ink enters into the sub ink chamber 34 even when the liquid level in the ink chamber 13 lowers, because carriage scanning during a recording operation causes the liquid surface in the ink chamber 13 to oscillate and become turbulent. The ink chamber 13 is provided with a wall intended to make it difficult for ink to drop, thereby always holding a small amount of ink.

The ink absorber 16 may be formed of any material as long as it produces an appropriate capillary force at the interface with ink. For instance, a porous material, such as a polyester felt or polyurethane material, or a porous material or a three-dimensional fibrous structure or the like may be used.

Furthermore, a mesh type material, such as a metallic or resinous fiber piece, a porous member or the like may be used for the filter. The ink absorber 16 may have filtering accuracy that is coarser than that of the filter 19 and may have a filtering accuracy of, for example, about 70 μm. If the ink absorber 16 is formed of a soft member, such as a polyester felt, then it should be formed into a cylindrical shape and disposed in a compressed state so as to enhance close contact with a wall surface. The ink absorber 16 impregnated with ink functions as a means for controlling negative pressure when environmental changes take place. For instance, the air in the upper layer in the ink chamber 13 relatively expands when air pressure falls or the temperature of the ink tank 12 rises. The expanded air is gradually released to the atmosphere through the air lead-in passage 35, the ink absorber 16 impregnated with ink, the hydrophobic porous member 27, and the atmosphere communicating hole 18. A plurality of the air lead-in passages 35 may be disposed in parallel or disposed on both sides of the ink absorber 16 to ensure smooth movement of air.

The air expanded as mentioned above is gradually released out of the ink tank through the intermediary of the ink absorber 16 fully impregnated with ink so as to prevent the internal pressure from rising over a certain level. Conversely, when the ink in the ink chamber 13 is consumed by a recording operation of the print head 11, causing a drop in the internal pressure, the air adjacent to the atmosphere that has a higher pressure gradually enters into the ink chamber 13 through the atmosphere communicating hole 18, the hydrophobic porous member 33, the ink absorber 16 impregnated with ink, and the air lead-in passage 35 extending along the ceiling wall of the sub ink chamber 34.

Thus, the air inside and outside is directly moved through the intermediary of the ink absorber 16 impregnated with ink so as to maintain the negative pressure in the ink chamber 13 relative to the print head 11 within a predetermined range. The adjustment range of the negative pressure in the ink chamber 13 depends upon the capillary force from the surface tension of the ink acting on the ink absorber 16 and the acting distance thereof.

Selecting an optimum density of the ink absorber 16 and an optimum distance inside the air lead-in passage makes it possible to maintain the negative pressure in the ink chamber 13 within an appropriate range. Thus, by directly moving the air inside and outside the ink tank 12 through the intermediary of the ink absorber 16 impregnated with ink, ink can be stored in a free state in the ink tank 12 without accommodating a large-capacity ink absorber that takes up about half the ink tank, as compared with the ink tank shown in FIG. 7. This leads to dramatically improved utilization efficiency of the space in the ink tank.

The hydrophobic porous member 33 functions to prevent outflow of the ink impregnated in the ink absorber 16 so as to maintain interface with the atmosphere. The hydrophobic porous member 33 can be a non-wetting, that is, hydrophobic, polymer member. For instance, a Teflon (registered trademark) or nylon mesh having a pore size of about 10 microns is used. Recently, a rod-shaped member or the like commercially available under a GORE-TEX trademark may be used.

According to the embodiment described above, as in the case of the first embodiment, ink can be stored with high volume efficiency according to a simple method in which expansion and contraction of the air in the liquid accommodating container caused by environmental changes are directly accommodated using a small ink absorber impregnated with ink. Furthermore, it is possible to provide an efficient liquid accommodating container for an ink-jet recording apparatus that allows stored ink to be substantially used up 100%. In addition, the large ink absorber can be eliminated from the liquid accommodating container, which is a consumable, thus permitting reduced cost to be achieved.

Third Embodiment

A third embodiment will now be described, focusing mainly on aspects that are different from the first embodiment.

Figure 4A:
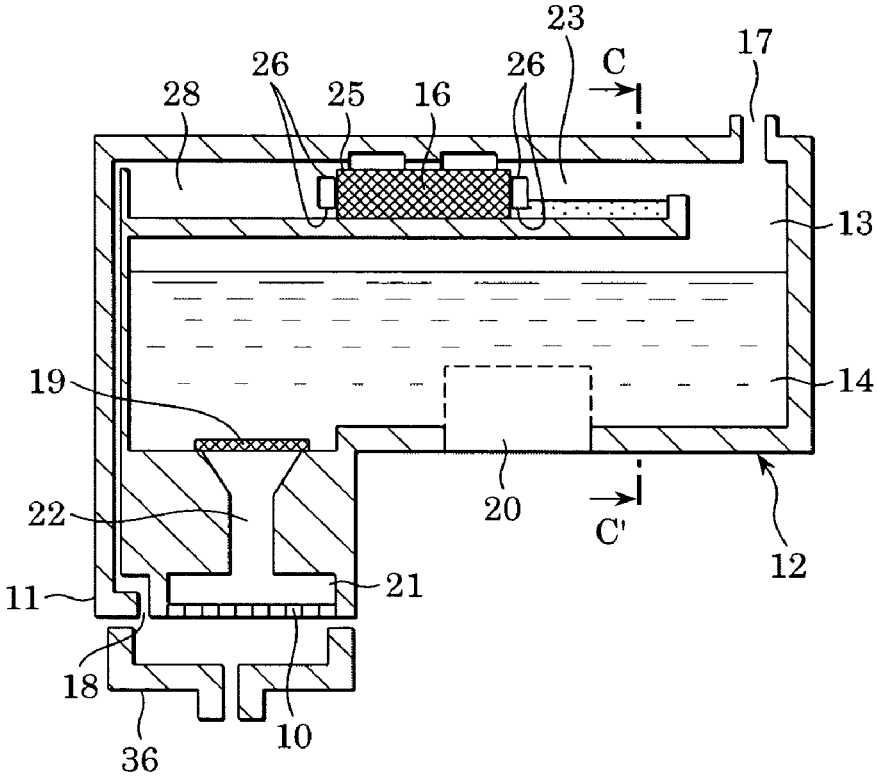
FIGS. 4A and 4B show a liquid accommodating container according to a third embodiment of the present invention, FIG. 4A being a sectional view taken along a surface of a maximum area of the ink tank, and FIG. 4B being a sectional view taken along line C–C' shown in FIG. 4A.
Figure 4B:
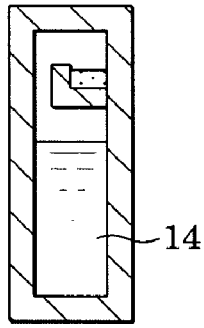

FIGS. 4A and 4B show a liquid accommodating container according to the third embodiment of the present invention. FIG. 4A is a sectional view taken along a maximum-area surface of an ink tank, and FIG. 4B is a sectional view taken along line C–C'. In the present embodiment, as shown in FIGS. 4A and 4B, an atmosphere communicating hole 18 providing communication between an empty chamber 28 and the surface of a print head 11 on which a nozzle assembly 10 has been formed is formed along on an inner side wall of the ink tank 12.

A suction cap 36 is connectable to the surface of the print head 11 in which the atmosphere communicating hole 18 is opened and on which the nozzle assembly 10 has been formed. The suction cap 36 is connected to a suction pump (not shown). The suction pump enables the nozzle assembly 10 to draw ink in. The ink tank 12 is moved to move the nozzle assembly 10 to a predetermined position where the suction cap 36 is pushed against the surface of the print head 11 where the nozzle assembly 10 is formed, and then the suction pump is actuated. This causes the ink in the ink chamber 13 to be drawn in through the nozzle assembly 10 via an ink passage 22. At the same time, the air in the upper portion of the ink chamber 13 is drawn in through the atmosphere communicating hole 18.

The viscosity coefficient of air is about two digits lower than that of ink. Hence, the air is overwhelmingly drawn in first, so that the internal pressure in the ink chamber 13 drops. Thus, the ink is drawn in through an ink inlet 17 to which the main tank is connected, causing the ink surface level to rise. When the ink reaches an ink absorber 16 after replenishing, the substance passing through the ink absorber 16 switches from the gas to the liquid with a resultant sudden increase in resistance, leading to dominant suction of the ink from the nozzle assembly 10. Thus, the ink chamber 13 is filled with the ink, and then the ink is interchanged so as to form a meniscus relative to the nozzle assembly 10.

As in the first embodiment, according to the present embodiment, the negative pressure in the ink chamber 13 is maintained substantially at a fixed level when ink is consumed as the print head discharges the ink or environmental changes take place. Furthermore, as in the first embodiment, the replacement ink tank shown in FIG. 2 can be connected to the ink inlet 17 also in the present embodiment. The ink inlet 17 shown in FIG. 4 is open, whereas it is sealed when the ink tank is used. The replacement ink tank holds ink in a soft bag-shaped container and retained below the ink tank 12, maintaining a negative head pressure.

According to the present embodiment, the opening of the atmosphere communicating hole 18 that provides communication between an ink absorber chamber 25 and the atmosphere is disposed in the vicinity of the nozzle assembly 10 of the print head 11. With this arrangement, ink is replenished by a suction recovery pump used for "recovery operation." Thus, the nozzle assembly 10 is covered by the suction cap 36, and the ink is drawn in through the ink discharge openings of the nozzle assembly 10, obviating the need for an additional power source for replenishing the ink. During the recovery operation, the ink is replenished, so that the ink in the ink chamber 13 does not run out during printing on recording paper. This permits uninterrupted printing onto a recording medium.

Moreover, the sizes of the ink absorbers 16 that take up a large volume in the conventional liquid accommodating containers shown in FIG. 6 through FIG. 8 can be reduced to take up only a minimum volume in a part of the upper space of the ink chamber 13 in the present embodiment. In addition, the expansion and contraction of the air inside and outside the ink chamber 13 caused by environmental changes can be accommodated by a simple construction, namely, by directly accommodating such expansion and contraction by a small ink absorber 16, without moving ink.

Fourth Embodiment

Figure 5:
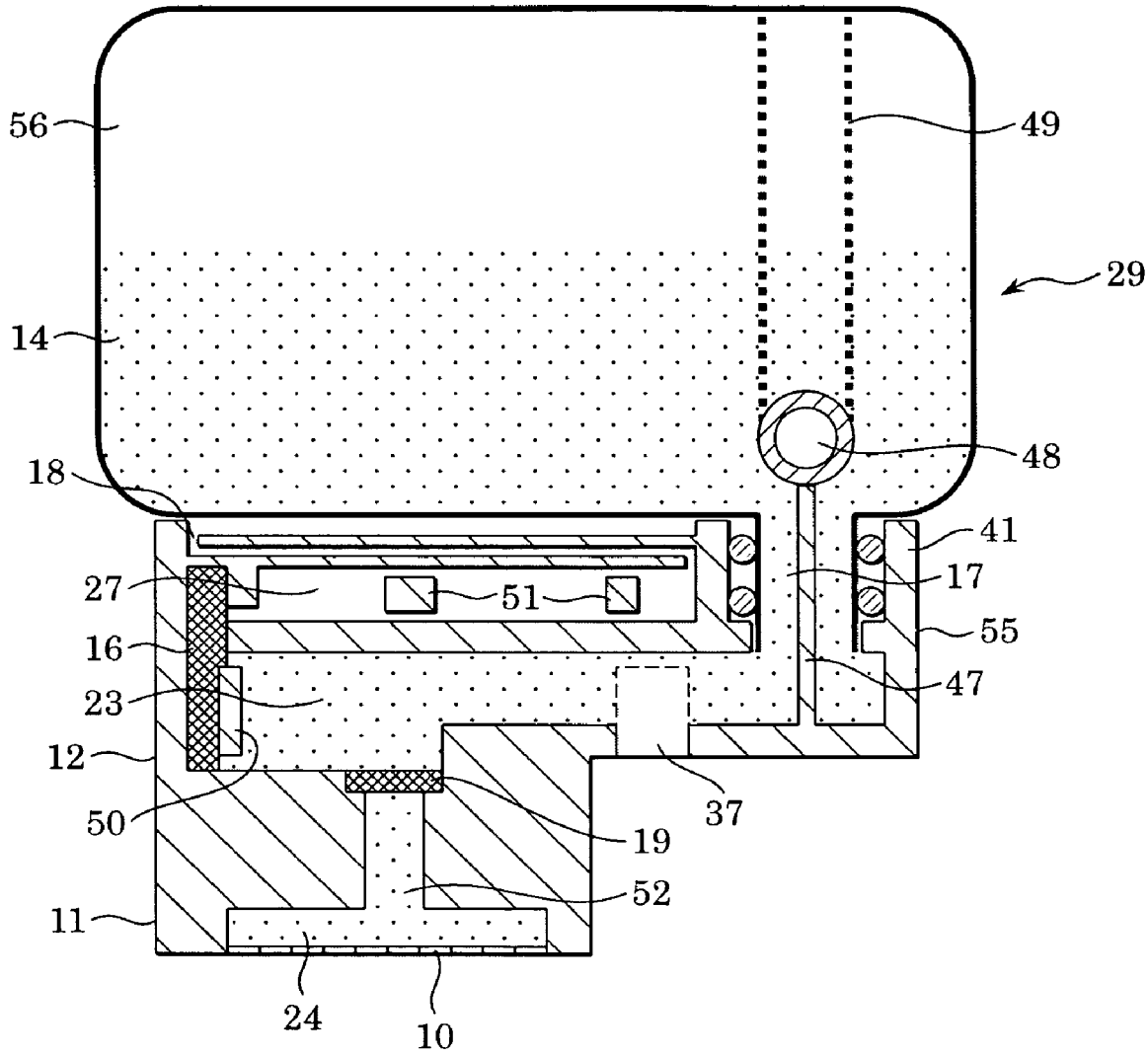
FIG. 5 is a sectional view showing an ink tank and a print head, which have been connected in an ink supply apparatus, according to a fourth embodiment of the present invention.

FIG. 5 is a sectional view of an ink supply mechanism of an ink supply apparatus according to a fourth embodiment. A replacement ink tank 29 holds ink in a free state and is detachably installed to an ink tank 12 provided with a print head 11. The ink tank 12 further includes a nozzle assembly 10, an ink remaining amount detecting member 37, and a sub ink chamber 23 for storing ink in a buffering manner when the replacement tank 29 is installed. Reference numeral 14 denotes ink. An upper portion 56 is occupied by an air layer. Reference numeral 17 denotes an ink inlet. The replacement tank 29 is attached to the ink tank 12. FIG. 5 shows the replacement tank 29 that has been installed.

A toroidal O-ring 41 disposed around a cylindrical ink outlet passage wall of the ink tank 12 keeps the replacement tank 29 and the sub ink chamber 23 shut off from open air, the O-ring 41 being disposed between the ink inlet 17 of the ink tank 12 and a rim portion 55. A spherical plugging member 48 urged by a spring member 49 that maintains a sealed state by preventing ink leakage when ink is stored in the replacement tank 29 in isolation or the replacement tank 29 is detached is pushed away in the replacement tank 29 by a protuberant member 47 disposed in the ink tank 12.

The cylindrical distal end of the ink outlet of the replacement tank 29 is positioned in the ink tank 12. The air in the ink tank 12 enters the replacement tank 29, while the ink in the replacement ink tank 29 is discharged into a sub ink chamber 23 in the ink tank 12, thereby accomplishing the gas-liquid exchange. The ink remaining amount detecting member 37 is an optical reflector molded using a transparent plastic member having a 45-degree isosceles right triangle shape. Although not shown, when light is emitted from outside, the refractive index ratio of ink to air relative to the plastic changes from about 1.5:1.3 to about 1.5:1.0 when the ink runs out, and emitted light comes to be fully reflected back at a boundary defined by COS 45°=about 1.4. This is how it is determined whether the ink has run out.

The print head 11 is made integral with the ink tank 12 and connected to a head liquid chamber 24 by a connecting passage 52 through the intermediary of a filtering member 19. The print head 11 has numerous nozzles densely formed. For example, 128 nozzles may be formed at a density of 300 dpi. Each nozzle is provided with a heating element for generating air bubbles by energization to discharge ink in the form of droplets. In FIG. 5, ink droplets are discharged downward.

Although not shown, a printed wiring board or the like for supplying electrical signals to the print head 11 is provided. A housing of the replacement tank 29 or the ink tank 12 is rigid, and a material exhibiting high resistance to ink is selected for the housing. The ink tank 12 is released to open air through an atmosphere communicating hole 18. The atmosphere communicating hole 18 is illustrated as a simple opening in the figure, whereas it is actually formed in a fine, long mazy pattern to prevent outflow of ink. The atmosphere communicating hole 18 is in communication with the sub ink chamber 23 through the intermediary of an ink absorber 16. The ink absorber 16 extends to the bottom of the sub ink chamber 23 to supply ink.

A plurality of spaces 27 separated by a partition 51 is disposed on the open air side of the ink absorber 16. When the ink tank 12 is filled up with the ink 14, no more air enters the replacement tank 29 and the ink 14 does not move into the sub ink chamber 23 of the ink tank 12, producing a sealed state. The filtering member 19 is provided in the connecting portion between the sub ink chamber 23 and the ink passage 52. The filtering member 19 is provided to prevent waste, foreign matter, coagulated ink components, air bubbles, etc. from entering into the nozzle assembly 10. The filtering member 19 has a filtering accuracy of about 20 μm to block foreign matters of a size that clogs the nozzles of the print head 11.

For the ink absorber 16, a polyester felt, for example, may be used; however, the material of the ink absorber 16 is not limited thereto. Any material may be used as long as it produces an appropriate capillary force at the interface with ink. For instance, a porous material, such as a polyurethane material, or a fibrous structure or the like may be used. Furthermore, a mesh type material, such as a wire mesh or a resinous mesh, a porous member or the like may be used. The ink absorber 16 may have filtering accuracy that is coarser than that of the filter 19, and may have a filtering accuracy of, for example, about 70 μm. The ink absorber 16, however, is preferably formed of multiple layers of metal laminates with ink held among the gaps thereof or a mesh type metal fiber member rather than a chemical member that may cause ink to deteriorate in a prolonged use.

The ink absorber 16 functions as a means for controlling a negative pressure when an ambient environment changes. For instance, if an ambient air pressure drops or an ambient temperature in the replacement tank 29 relatively rises, then the air in the replacement tank 29 storing ink relatively expands. The pressure of the expanded air gradually pushes the ink in the sub ink chamber 23 toward the open air side through the intermediary of the ink absorber 16 thereby to prevent the air pressure from rising above a predetermined level. Conversely, if the ink in the sub ink chamber 23 is consumed by recording and the ink decreases with a consequent drop in the internal pressure of the replacement tank 29, then the air adjacent to open air that has a higher pressure is gradually moved into the ink tank 12 in the form of minute air bubbles through the intermediary of the atmosphere communicating hole 18 and the ink absorber 16. This arrangement maintains the negative pressure in the replacement tank 29 substantially at a constant level. The adjustment range of the negative pressure in the replacement tank 29 depends on the capillary force of the ink absorber 16. The negative pressure in the ink chamber can be maintained at an optimum level by optimizing the capillary force.

The ink tank 12 temporarily holds a small amount of ink in order to implement important roles. The important roles primarily include filtering ink through the filtering member 19 before supplying the ink to the nozzle assembly, artificially sealing the replacement tank 29 from open air by the atmosphere communicating hole 18 wherein the ink absorber 16 fully impregnated with ink is disposed, and determining the remaining amount of the ink. The replacement tank 29 is detachably installed to the ink inlet 17. This arrangement allows the ink in the replacement tank 29 to be stored in a free state. The cylindrical ink outlet extending from the replacement tank 29 maintains the sealing from open air by the O-ring 41. The plugging member 48 disposed in the replacement tank 29 is pushed away with its distal portion inserted in the ink tank 12. The ink 14 is replenished into the ink tank 12 as required by gas-liquid exchange.

A part of the ink absorber 16 is extended to always replenish the ink from the bottom of the sub ink chamber 23. Compressing the extended portion by a partition 50 as shown in the figure crushes the porous portion of the ink absorber, and a larger interfacial force acts between itself and the ink. Hence, even when the ink in the replacement tank 29 is used up and the water level in the ink tank 12 lowers, sufficient ink can be replenished to an upper portion of the ink absorber 16. If air 56 in the replacement tank 29 expands, the ink 14 passes through the ink absorber 16 and is pushed out to the space 27. At this time, the ink discharges, in the form of bubbles, the air contained in the ink absorber 16. The partition 51 having a pore in its upper portion prevents the bubbles from going outside. Once the ink sits on the bottom of the space 27, bubbles are no longer produced.

There may be a plurality of the spaces 27, and the total volume thereof is determined on the basis of a minimum air pressure that can be encountered and the ink capacity of the replacement tank 29. The ink temporarily retained in the space 27 is drawn back into the sub ink chamber 23 through the pore formed in a lower portion of the partition 51 when the internal pressure drops or the ink is consumed.

The embodiments described above make it possible to discontinue or minimize the use of the ink absorbing members taking up a large volume of the conventional liquid accommodating containers, as shown in FIG. 6 through FIG. 8. If the air in an ink chamber expands or contracts due to consumption of ink in a recording operation or environmental changes, then the spaces on both sides cooperatively move the air or ink through the intermediary of an ink holding member impregnated with ink so as to maintain the pressure in an ink chamber within a predetermined range, thus preventing a nozzle assembly from leaking ink or capturing air. It is possible to minimize the use of the ink absorbers occupying a large capacity of an ink chamber used in the conventional ink supply apparatuses. Furthermore, these pressure adjusting mechanisms are disposed adjacently to a recording head, and the ink tank has been designed to be a simple, detachable consumable. Most of the internal space adjacent to the ink tank and to the print head can be used for holding ink in a free state. Accordingly, if the size of the ink tank is the same, then more ink can be accommodated in an ink tank of the same size, or if the amount of ink remains the same, then the ink tank and the print head can be made smaller. Moreover, an efficient liquid accommodating container that allows all ink in the ink tank to be used up can be achieved.

In addition, ink can be stored with high volume efficiency according to a simple method in which expansion and contraction of air inside and outside the ink chamber caused by environmental changes are directly accommodated using a small ink absorber without moving the ink. Furthermore, the large ink absorber can be eliminated from the liquid accommodating container, which is a consumable, thus permitting reduced cost to be achieved.

The remaining amount of ink is detected in the sub ink chamber 23, so that the replacement tank 29, which is a consumable, is simply constructed of a container and the plugging member 48. The ink tank 12 can be fabricated using a single component by blow molding, as in the case of a PET bottle. Thus, it is possible to provide a head cartridge formed of a print head having an efficient ink tank 12 that is available at lower cost and that allows ink to be used up.

The mechanisms for connecting the ink tanks described in the above first embodiment and the fourth embodiment (refer to FIG. 2 and FIG. 5) may be applied to other ink tanks in the second and third embodiments, as appropriate. Similarly, the mechanism for making the ink tank and the print head connectable and separable explained in the second embodiment may be applied to other embodiments, as appropriate.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-402374 filed Dec. 2, 2003, which is hereby incorporated by reference herein.

What is claimed is:

1. A container for holding a liquid to be supplied to a liquid discharge head operable to discharge the liquid, the container comprising:

a housing;

a first chamber adapted to store the liquid in a free state;

other liquid chambers including second and third chambers;

the second chamber provided on the housing and defining a first space that facilitates communication between the first chamber and an atmosphere, wherein the first chamber has a portion in communication with the atmosphere;

a liquid absorbing member disposed in the second chamber; and the third chamber defining a second space between the atmosphere and the liquid absorbing member, wherein the first chamber is adapted to store an amount of liquid larger than each of the other liquid chambers, and wherein the first chamber directly supplies the liquid to the liquid discharge head and the other liquid chambers supply liquid to the liquid discharge head via the first chamber.

2. A container according to claim 1, wherein the second chamber includes a liquid absorbing member accommodating chamber adapted to accommodate the liquid absorbing member, a fourth chamber adapted to store the liquid in the free state, and a partition having an opening and separating the liquid absorbing member accommodating chamber and the fourth chamber, wherein the liquid absorbing member accommodating chamber is in direct communication with the atmosphere, wherein the liquid absorbing member accommodating chamber is in communication with the fourth chamber via the opening of the partition, and wherein the fourth chamber is in communication with the first chamber.

3. A container according to claim 2, wherein the liquid absorbing member accommodating chamber includes a third space.

4. A container according to claim 1, further comprising a replacement liquid container holding liquid and configured to communicate with the first chamber to supply liquid to the first chamber.

5. A container according to claim 4, further comprising:

a liquid inlet facilitating supply of liquid from the replacement liquid container into the first chamber; and the replacement liquid container including a liquid lead-out portion adapted to communicate with the liquid inlet.

6. A liquid accommodating container for accommodating a liquid to be supplied to a liquid discharge head that discharges the liquid comprising:

a housing;

a first chamber provided within the housing and adapted to store the liquid in a free state, the first chamber having an upper space above the liquid stored therein;

other liquid chambers including second, third, and fourth chambers;

the second chamber provided within the housing, the second chamber being separated from the first chamber and in the upper space;

an atmosphere communicating hole defined in the housing and allowing communication between the first chamber and an atmosphere via the second chamber;

a hydrophobic porous member disposed between the atmosphere communicating hole and the second chamber;

a liquid absorbing member disposed adjacent to the porous member and in the second chamber;

the third chamber provided within the housing, the third chamber communicating between the second chamber and the atmosphere communicating hole; and the fourth chamber adapted to store the liquid in the free state, the fourth chamber defining a space adjacent to said liquid absorbing member in said second chambers, wherein the first chamber is adapted to store an amount of liquid larger than each of the other liquid chambers, and wherein the first chamber directly supplies the liquid to the liquid discharge head and the other liquid chambers supply liquid to the liquid discharge head via the first chamber.

7. A liquid accommodating container according to claim 6, further comprising a joint connected to the liquid discharge head, wherein the joint has a liquid lead-out passage leading the liquid in the first chamber to the liquid discharge head.

8. The liquid accommodating container according to claim 7, wherein the liquid absorbing member is disposed in a compressed state in the second chamber, and wherein the housing includes an air lead-in passage provided between the atmosphere communicating hole and the hydrophobic porous member.

9. A liquid accommodating container according to claim 6, further comprising a liquid discharge nozzle assembly provided at the liquid discharge head, wherein the atmosphere communicating hole allows communication between the air in the second chamber and the atmosphere at the liquid discharge nozzle assembly.

10. A liquid supply apparatus comprising:

the liquid accommodating container according to claim 6;

a liquid discharge nozzle assembly provided at the liquid discharge head; and a suction unit configured to simultaneously draw in the air from the second chamber and the liquid from the liquid discharge nozzle assembly through the atmosphere communicating hole.

* * * * *